United States Patent [19]

Armstrong

[11] Patent Number: 4,941,283

[45] Date of Patent: Jul. 17, 1990

[54] SUPPORT STRUCTURE FOR MULTIPLE PLANTS

[76] Inventor: Edward Armstrong, P.O. Box 651-613, Louisa, Va. 23093

[21] Appl. No.: 118,896

[22] Filed: Nov. 10, 1987

[51] Int. Cl.[5] ..... A47G 7/04; F16M 11/32

[52] U.S. Cl. ..... 47/67; 47/39; 248/163.2; 248/27.8

[58] Field of Search ..... D11/143, 139, 144, 145, D11/146, 147; 47/39, 44, 47, 67, 45, 46, 66; 248/188.7, 351, 27.8, 163.1, 163.2

[56] References Cited

U.S. PATENT DOCUMENTS

| | | | |
|---|---|---|---|
| 1,639,318 | 9/1925 | Viewegh | 248/163.1 |
| 1,806,454 | 10/1928 | Goudeau | 248/163.2 X |
| 2,924,414 | 2/1960 | Tesdal | 248/163.2 X |
| 3,262,406 | 7/1966 | Nickolaisen | 248/163.1 X |
| 4,015,806 | 4/1977 | Cattermole | 248/163.1 X |
| 4,339,880 | 7/1982 | Hall | 248/163.1 X |
| 4,603,507 | 8/1986 | Nelson | 47/67 |
| 4,695,021 | 9/1987 | Leinfelder | 248/163.1 |

FOREIGN PATENT DOCUMENTS

| | | | |
|---|---|---|---|
| 11837 | 9/1928 | Australia | 248/163.2 |

OTHER PUBLICATIONS

Installment Retailing, 9/1956, p. 40.

*Primary Examiner*—Danton D. DeMille
*Attorney, Agent, or Firm*—A. W. Breiner

[57] ABSTRACT

A structure and method for supporting multiple potted plants from a tripod-like support structure is provided. The structure and method of support provide for the concealment of a portion of the support structure by a potted plant so as to enhance the aesthetic appeal of the support structure.

4 Claims, 1 Drawing Sheet

SUPPORT STRUCTURE FOR MULTIPLE PLANTS

FIELD OF INVENTION

The present invention is directed to a means and method of supporting multiple plants, in particular potted plants, in a decorative manner. In addition to supporting multiple plants, the support structure is designed so that a plant in place provides for the concealment of a portion of the support means.

BACKGROUND OF INVENTION

Various plant support structures are known in the art, including supports utilizing a tripod structure. Examples of the art include:

U.S. Pat. No. 2,289,729 which discloses a floral display rack having a tripod support structure with reinforcing bars located between the leg structures. Additionally, a suspension hook is located at the top of the tripod from which a display rack can be hung. Plants are hung from the display rack so that the rack is hidden from view.

U.S. Design Pat. No. 21,044 which discloses a flower easel having three legs. Crossbars extend across the top two legs to support a plant structure. Chains are strung between the legs which are utilized to support hanging plants.

Figure 1:
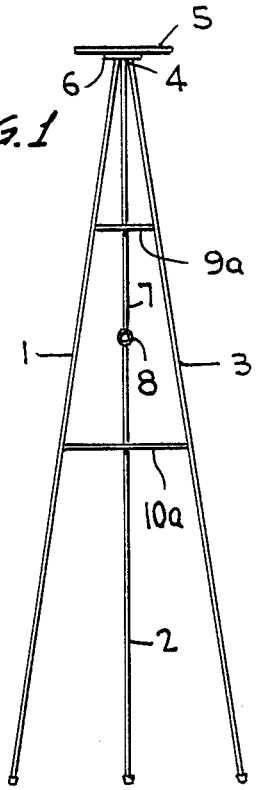

U.S. Pat. No. 1,897,905 discloses a flower stand having three vertical supports with crossbars extending between the supports near the bottom end of the supports and a shelf positioned between the supports near the top end of the supports. A potted plant can be set on the shelf. A second potted plant can be set on the crossbars of the flower stand, as shown in FIG. 1.

U.S. Pat. No. 936,619 which discloses a flower pot stand capable of supporting a potted plant at its top end as well as a potted plant in its center. The support of the pots do not utilize a shelf or suspension means.

The art does not disclose the combined plant support structure of the present invention.

OBJECTS OF INVENTION

One of the primary objects of the present invention is to provide a means and method of supporting multiple potted plants utilizing a structure which is both sturdy and decorative.

A further primary object of the present invention is to provide a means and method of supporting multiple potted plants so that the plants provide concealment of a portion of the support means, thereby enhancing the decorative feature of the present invention.

FIGURES

FIG. 1 presents a front elevational view of the present invention.

Figure 2:
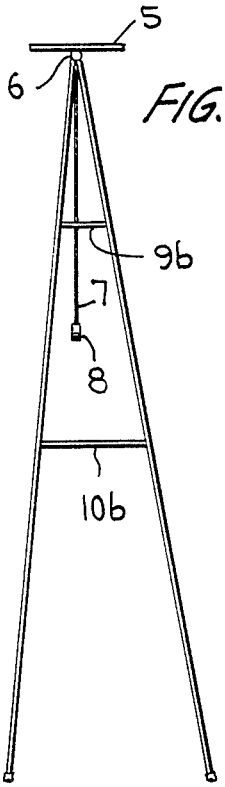

FIG. 2 presents a right side elevational view of the present invention with the left side being a mirror image.

Figure 3:
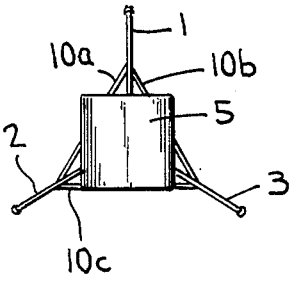

FIG. 3 presents a top plan view of the present invention.

Figure 4:
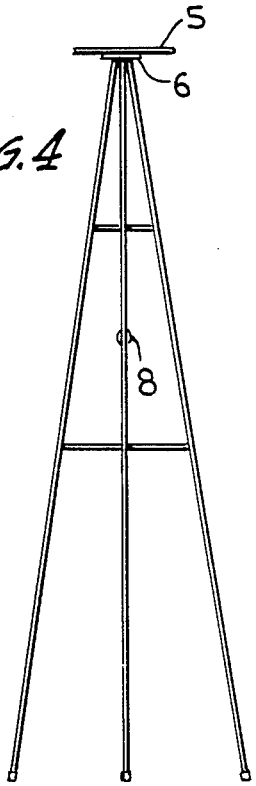

FIG. 4 presents a rear elevational view of the present invention.

Figure 5:
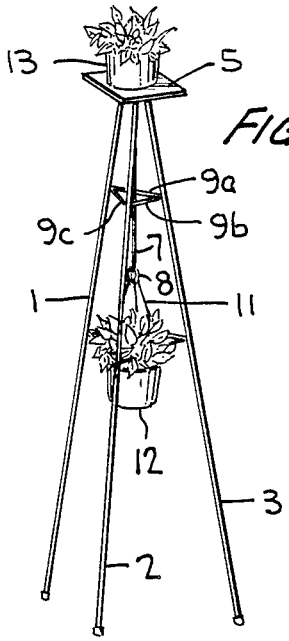

FIG. 5 presents a perspective view of the present invention showing multiple potted plants being supported by the structure of the present invention.

BRIEF DESCRIPTION OF INVENTION

The present invention is directed to a support structure for holding multiple potted plants which utilizes a tripod-like structure and a method for using the support structure. More particularly, the support structure has three legs which are joined at their top to form a tripod. Positioned on top of the joined legs is a platform. Extending downward from the area below the platform into the central area between the three legs is a rod having a suspension means located at the end of the rod away from the platform. Two sets of three crossbars are positioned between the legs of the support structure to provide additional strength to the structure. None of the crossbars extend through the central area located between the legs. One set of crossbars is situated across the top half of the legs. The second set of crossbars is located at a point below the end of the rod which extends downward from the area below the platform. One or more potted plants can be seated on top of the platform. An additional potted plant can be suspended from the rod extending downward from the platform area. The potted plant suspended from the rod conceals the second set of crossbars from view thereby enhancing the aesthetic appeal of the plant support structure.

PREFERRED EMBODIMENT OF THE PRESENT INVENTION

15 The present invention comprises a support structure for multiple potted plants having a tripod-like structure. The structure is preferably made from a metallic material but can also be made from a rigid plastic or wood. The metallic material utilized can be lightweight such as aluminum. Additionally, the material utilized can have various finishes which would be appropriate to the decorative nature of the support structure.

The structure comprises three legs 1, 2, and 3 which are joined at the top of the legs 4 to form a tripod. The legs can be joined by any conventional means such as screw(s), adhesive, bracket(s) or the like or they can be joined directly to platform 5.

Attached to the top of the three joined legs is platform 5. The platform can be attached to the legs by any conventional means, such as screw(s), an adhesive, bracket(s) or the like. An additional support 6 can be interposed between the top of the legs 4 and the platform 5 to provide a structure to which the legs and the platform can each be commonly joined.

Extending downward from the center point of the three joined legs is a rod 7 which has a suspension means 8, such as a hook, ring or the like, located at the free or bottom end of the rod.

The support has at least one set of crossbars extending between the legs of the support structure. None of the crossbars extend through the central area between legs 1, 2, and 3. Preferably, two sets of three crossbars are positioned between legs 1, 2, and 3 for the purpose of providing additional support to the structure. The use of crossbars, either one or multiple sets, enables the positioning or holding of heavy potted plants by the support structure without the structure's legs spreading in the outward direction.

In the preferred embodiment where two sets of crossbars are utilized, the first set of crossbars **9*a*, 9*b*, and 9*c* are located in the top half of the leg structure. The exact height of the first set of crossbars is not critical. The height need only be sufficiently low so as to provide additional support but not so low to the bottom half of the legs as to be redundant to the second set of crossbars. The first set of crossbars comprises one bar extending between a first and second leg so that there are a total of three bars. See FIG. 5. None of the crossbars extend through the central area between legs 1, 2, and 3**.

The second set of crossbars is positioned between the legs of the structure in the same manner as the first set of crossbars with the exception that the second set is positioned farther down from the top of the legs so as to provide support to the lower portion of the legs. The second set of crossbars 10*a*, 10*b*, and 10*c* are positioned below the suspension means 8 of rod 7. As shown in FIG. 5, a plant can be suspended from suspension means 8 so that the plant is located in the central area between the legs of the support structure. The suspended potted plant is hung in such a manner that the plant conceals the second set of crossbars thereby enhancing the aesthetic appeal of the support structure. The location of the second set of crossbars between the legs 1, 2, and 3 can be at any desired point. In order to ensure that the plant suspended from rod 7 conceals the crossbars 10*a*, 10*b*, and 10*c*, it is only necessary to change the length of the support means 11 from which the suspended plant 12 is hung. When only one set of crossbars is utilized, the position of the crossbars will be as described with respect to the second set of crossbars 10*a*, 10*b*, and 10*c* above.

In addition to suspending a plant from rod 7, plants, such as plant 13, can be seated upon platform 5, see FIG. 5. The size and shape of platform 5 can be of any desirable size and shape. The only limitation is that platform 5 not be so large or lopsided in shape as to cause the support to be top heavy and thereby unstable. Platform 5 can also be of a shape and/or size which allows the plant situated on top of the platform to conceal the platform.

As will be apparent to one skilled in the art, various modifications can be made within the scope of the aforesaid description. Such modifications being within the ability of one skilled in the art form a part of the present invention and are embraced by the appended claims.

I claim:

1. A method of supporting multiple plants from a plant support structure which comprises:

three legs forming a tripod, said three legs being joined at their top;

a platform attached to the top of said tripod;

a rod extending downward from the area below said platform with a suspension means attached to the free end of said rod; and at least one set of three crossbars attached to and extending between said legs of said tripod without said crossbars extending through the central area between said legs;

wherein at least one plant is seated on said platform and at least one plant is suspended from said suspension means at the free end of said rod.

2. The method of supporting multiple plants from a plant support structure as claimed in claim 1 wherein said crossbars extending between said legs of said tripod are positioned below the level of said suspension means at the end of said rod and are concealed from view when a plant is suspended from said suspension means.

3. A plant support structure comprising:

three legs forming a tripod, said three legs being joined at their top;

a platform constructed and arranged to hold at least one plant attached to the top of said tripod;

a rod extending downward from the area below said platform with a suspension means attached to the free end of said rod; and at least one set of three crossbars attached to and extending between said legs of said tripod without said crossbars extending through the central area between said legs.

4. The plant support structure of claim 3 wherein one set of said crossbars extending between said legs of said tripod are positioned below the level of said suspension means at the end of said rod and are concealed from view when a plant is suspended from said suspension means.

* * * * *